US009553355B2

(12) United States Patent
Chen et al.

(10) Patent No.: US 9,553,355 B2
(45) Date of Patent: Jan. 24, 2017

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventors: Yi-Ting Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 88 days.

(21) Appl. No.: 14/467,649

(22) Filed: Aug. 25, 2014

(65) Prior Publication Data

US 2015/0054695 A1 Feb. 26, 2015

(30) Foreign Application Priority Data

Aug. 26, 2013 (CN) ..... 2013 1 03740893

(51) Int. Cl.

| | |
|---|---|
| ***H01Q 1/24*** | (2006.01) |
| ***H01Q 5/335*** | (2015.01) |
| ***H01Q 9/04*** | (2006.01) |
| ***H01Q 1/42*** | (2006.01) |

(52) U.S. Cl.

CPC ..... *H01Q 1/243* (2013.01); *H01Q 1/42* (2013.01); *H01Q 5/335* (2015.01); *H01Q 9/0421* (2013.01)

(58) Field of Classification Search

None

See application file for complete search history.

(56) References Cited

U.S. PATENT DOCUMENTS

| | | | | |
|---|---|---|---|---|
| 2009/0231215 | A1* | 9/2009 | Taura | H01Q 1/243 343/702 |
| 2013/0050026 | A1* | 2/2013 | Vin | H01Q 1/22 343/700 MS |
| 2014/0266923 | A1* | 9/2014 | Zhou | H01Q 5/35 343/702 |

FOREIGN PATENT DOCUMENTS

| | | | |
|---|---|---|---|
| JP | 2010-28413 | A | 2/2010 |
| JP | 2013-524622 | A | 6/2013 |
| WO | 2008/026267 | A1 | 3/2008 |

* cited by examiner

*Primary Examiner* — Robert Karacsony
(74) *Attorney, Agent, or Firm* — Zhigang Ma

(57) ABSTRACT

An antenna structure includes a radiation body, a grounding portion, a feeding portion, and a variable capacitor. The grounding portion is coupled to the radiation body and is configured to couple to ground. The feeding portion is coupled between the radiation body and the variable capacitor, the feeding portion is configured to receive feeding signals via the variable capacitor.

11 Claims, 5 Drawing Sheets

ANTENNA STRUCTURE AND WIRELESS COMMUNICATION DEVICE EMPLOYING SAME

FIELD

The subject matter herein generally relates to antenna structures, and particular to a multiband antenna structure and wireless communication device employing same.

BACKGROUND

With improvements in the integration of wireless communication systems, antennas have become increasingly important. For a wireless communication device to utilize various frequency bandwidths, antennas having wider bandwidths have become a significant technology.

BRIEF DESCRIPTION OF THE DRAWINGS

Implementations of the present technology will now be described, by way of example only, with reference to the attached figures.

DETAILED DESCRIPTION

Figure 1:
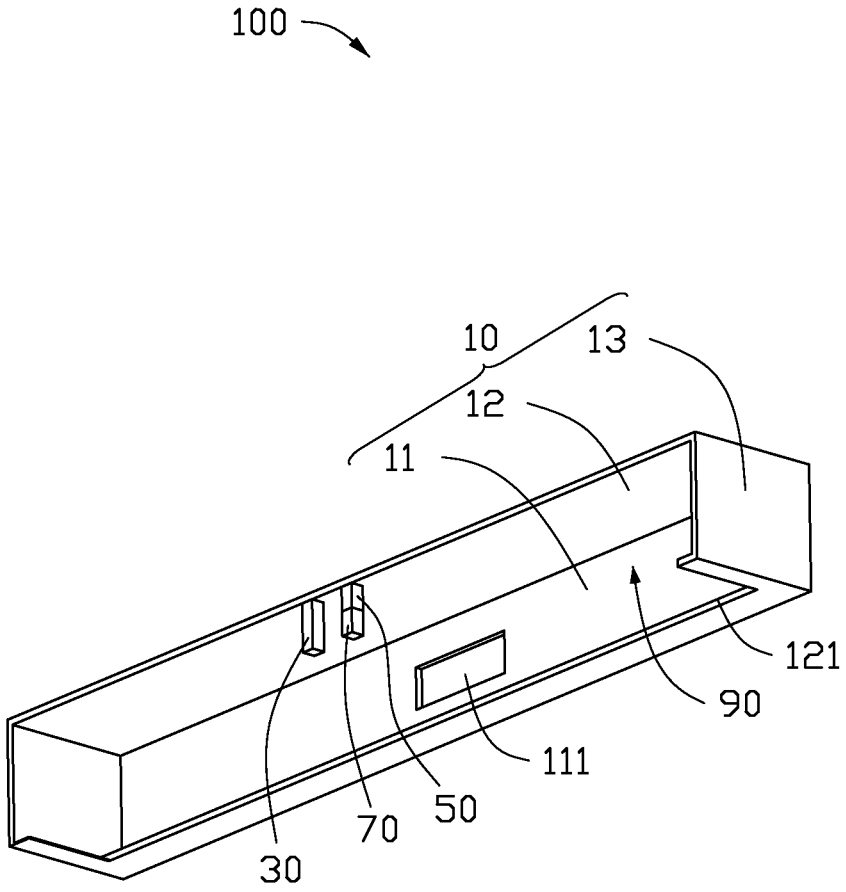
FIG. 1 is an isometric view of one embodiment of an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates an isometric view of one embodiment of an antenna structure 100. The antenna structure 100 can be used in a wireless communication device, such as mobile phone or tablet computer. The antenna structure 100 includes a radiation body 10, a grounding portion 30, a feeding portion 50, and a variable capacitor 70 (schematically shown). The radiation body 10 can serves as either a housing or one part of a housing of the wireless communication device. The grounding portion 30 is electronically coupled to the radiation body 10 and configured to couple the radiation body 10 to ground. The feeding portion 50 is coupled between the radiation body 10 and the variable capacitor 70. The feeding portion 50 can receive feeding signals from a feeding point of a signal source (not shown) via the variable capacitor 70.

As illustrated in FIG. 1, the radiation body 10 includes a first wall 11, two parallel second walls 12, and two parallel third walls 13. The second walls 12 are coupled to two opposite ends of the first wall 11 respectively. The third walls 13 are coupled to remaining opposite ends of the first wall 11 respectively, and are parallel to each other. Each of the two third walls 13 are coupled between the two second walls 12. The first, second and third walls 11, 12, and 13 cooperatively defines a space 90. In addition, the second walls 12 and third walls 13 are adjacent and form 90 degree angles. The first wall 11 defines a through hole 111 which can expose a connector, such as a USB connector, accommodated in the space 90.

The grounding portion 30 and the feeding portion 50 are substantially parallel to each other, and are substantially perpendicularly coupled to one of the second walls 12. The other one of the second walls 12 defines a substantially U-shaped cutout 121.

Figure 2:
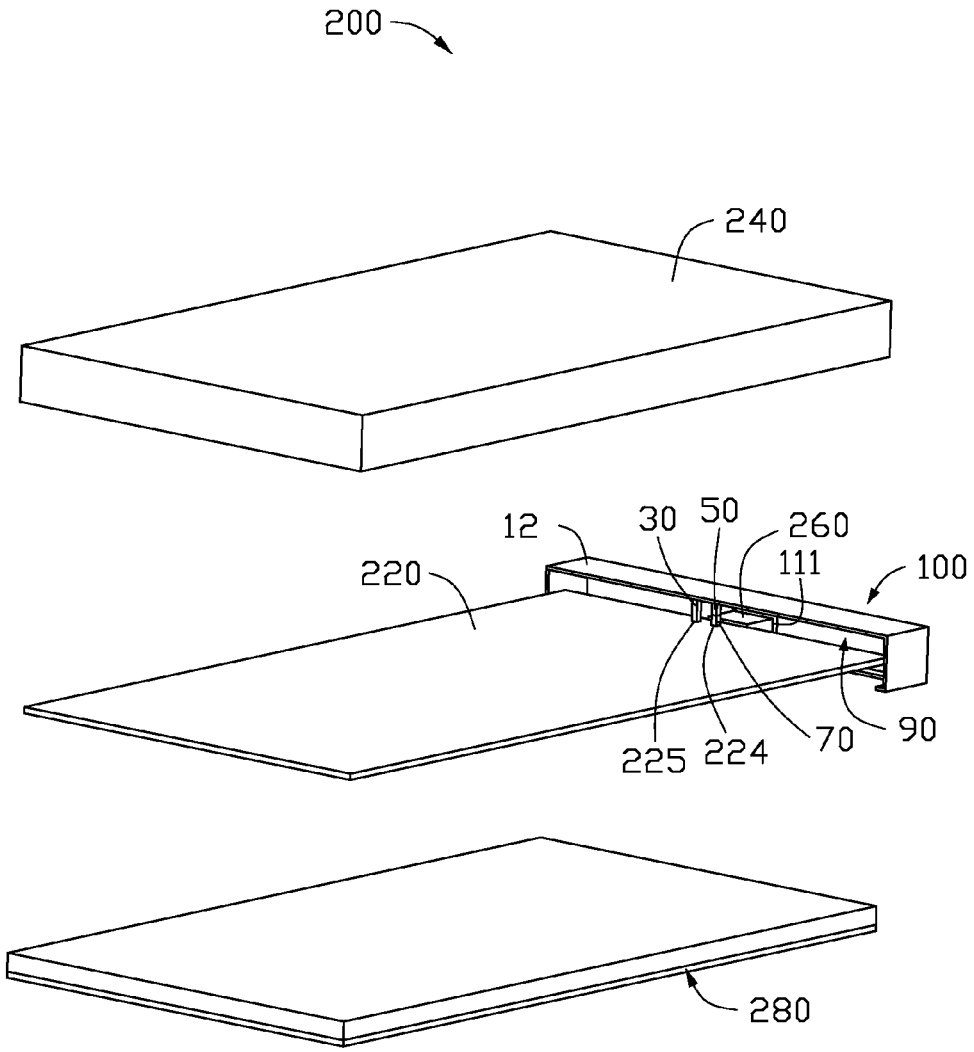
FIG. 2 is an exploded, isometric view of one embodiment of a wireless communication device employing the antenna structure shown in FIG. 1.

FIG. 2 illustrates an exploded view of one embodiment of a wireless communication device 200 employing the antenna structure 100 shown in FIG. 1. The wireless communication device 200 further includes a printed circuit board 220, a metal cover 240, a connector 260, and a display module 280. The printed circuit board 220 includes a grounding point 225 and a feeding point 224. The grounding point 225 can be grounded, and electronically coupled to one end of the grounding portion 30 opposite the second wall 12. The feeding point 224 is electronically coupled to one end of the variable capacitor 70 opposite the feeding portion 50, and can be coupled to a signal source (not shown), such that the feeding point 224 can output feeding signals to the feeding portion 50 via the variable capacitor 70.

The connector 260 is mounted to one end of the printed circuit board 220 and faces the though hole 111 (also see FIG. 1), the connector 260 can be accommodated in the space 90 and exposed from the through hole 111. The display module 280 can be mounted on the printed circuit board 220 opposite the metal cover 240.

Figure 3:
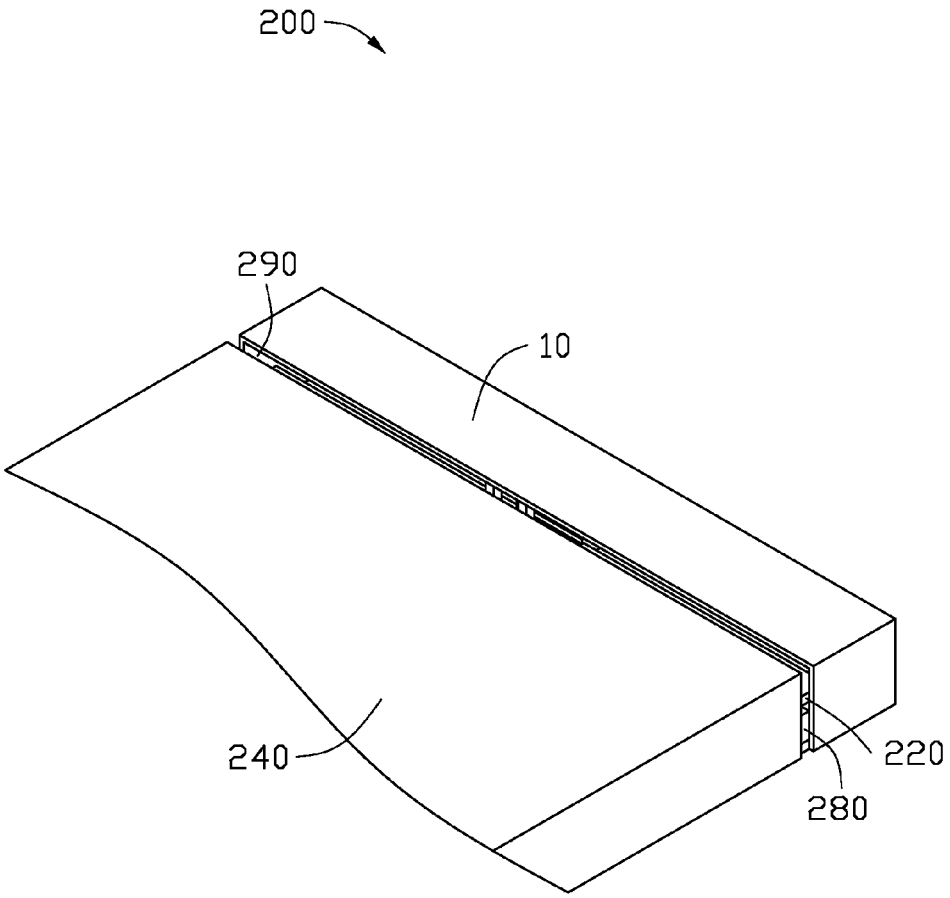
FIG. 3 is an isometric view of a part of the wireless communication device of FIG. 2.

FIG. 3 illustrates an isometric view of a part of the wireless communication device 200 of FIG. 2. In one embodiment, the radiation body 10 is a part of a housing of the wireless communication device 200, and the radiation body 10 and the metal cover 240 cooperatively forms the whole housing of the wireless communication device 200. A slit 290 is defined between the radiation body 10 and the metal cover 240, so that the radiation body 10 is insulated from the metal cover 240. In one embodiment, the slit 290 can be filled with dielectric materials, such as plastic, to achieve a complete appearance of the wireless communication device 200.

By changing the capacitance value of the variable capacitor 70, the operation frequency of the antenna structure 100 can be adjusted and the antenna characteristic can be improved. In one embodiment, the variable capacitor 70 can be a digital tuned capacitor that is an integrated circuit capacitor, such as a variable capacitor based on micro-electro-mechanical systems (MEMS) technology. In another embodiment, the variable capacitor 70 is a capacitance-variable diode of which the capacitance value can be changed by changing an applied voltage. In one embodiment, the capacitance value of the variable capacitor 70 can be set to 2.2 pF, 1.1 pF, and 0.6 pF.

Figure 4:
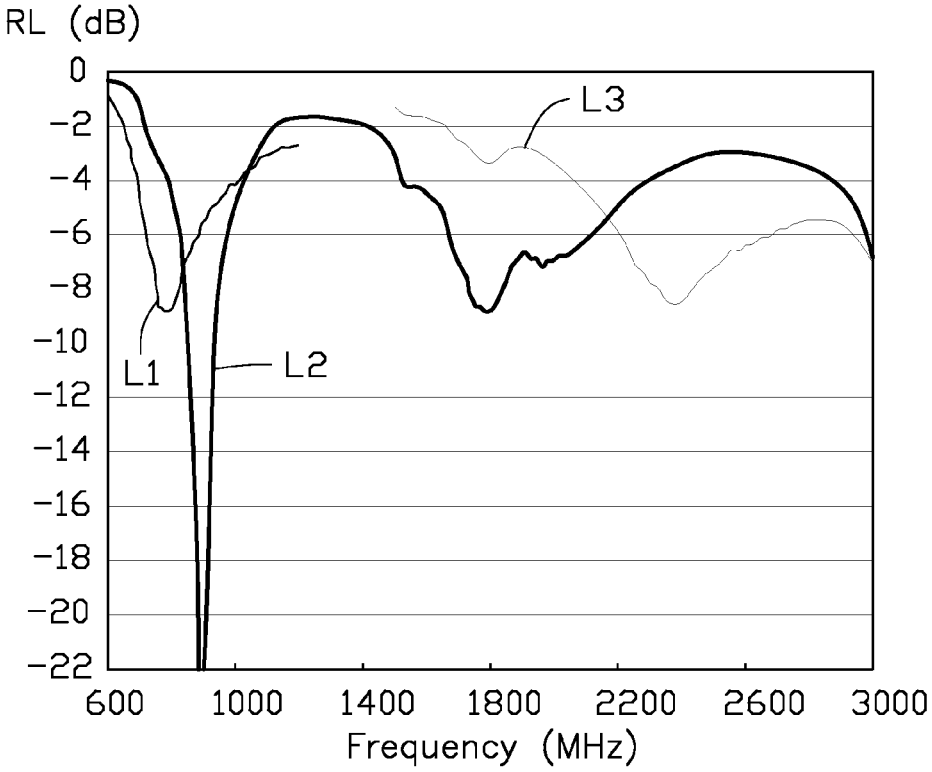
FIG. 4 is a diagram showing return loss (RL) measurement of the antenna structure of FIG. 1.

FIG. 4 illustrates a diagram showing return loss (RL) measurement of the antenna structure 100 of FIG. 1. Curve L1, L2 and L3 represent RL measurements of the antenna structure 100 when the capacitance value of the variable capacitor 70 is set to 2.2 pF, 1.1 pF, and 0.6 pF, respectively. It can be derived from FIG. 4 that a frequency range of the antenna structure 100 for low frequency is from about 704 MHz to about 960 MHz, and for high frequency is from about 1710 MHz to about 2690 MHz. Therefore, by adjusting the capacitance value of the variable capacitor 70, the antenna structure 100 can achieve a wide bandwidth.

Figure 5:
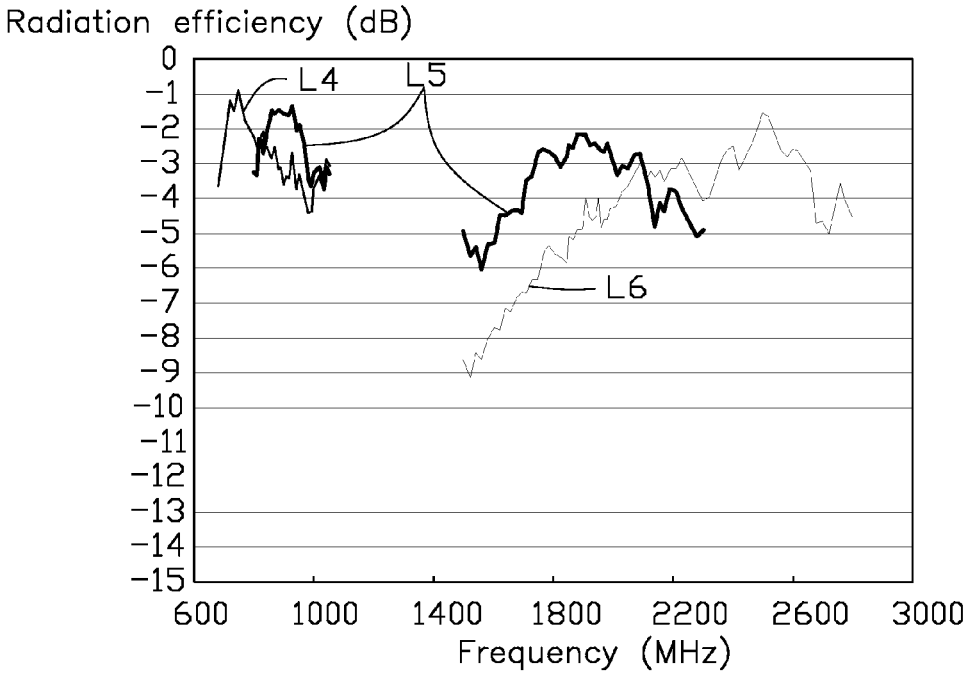
FIG. 5 is a diagram showing radiation efficiency measurement of the antenna structure of FIG. 1.

FIG. 5 illustrates a diagram showing radiation efficiency measurement of the antenna structure of FIG. 1. Curves L5, L6, and L7 represent radiation efficiency measurements of the antenna structure 100 when the capacitance value of the variable capacitor 70 is set to 2.2 pF, 1.1 pF, and 0.6 pF, respectively. As illustrated in FIG. 5, the radiation efficiency of the antenna structure 100 is greater than −5 dB when the antenna structure 100 receives/sends wireless signals at frequencies from about 704 MHz to about 960 MHz, and from about 1710 MHz to about 2690 MHz, such that the antenna structure 100 can achieve an exceptional communication quality.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wireless communication device comprising:

an antenna structure comprising:

a radiation body comprising a first wall, two second walls, and two third walls, wherein the second walls are coupled to two opposite ends of the first wall respectively and are parallel to each other; the third walls are coupled to another two opposite ends of the first wall respectively and are parallel to each other; each of the two third walls are coupled between the two second walls;

a grounding portion electronically coupled to the radiation body;

a variable capacitor; and a feeding portion positioned spaced from and parallel to the grounding portion, the feeding portion and the grounding portion substantially perpendicularly coupled to one of the second walls, wherein the feeding portion is coupled between the radiation body and the variable capacitor;

a printed circuit board comprising:

a grounding point electronically coupled to one end of the grounding portion opposite the radiation body; and a feeding point electronically coupled to one end of the variable capacitor opposite the feeding portion, and configured to output feeding signals to the feeding portion via the variable capacitor; and a metal cover covering on the printed circuit board and insulated from the radiation body, wherein a slit is defined between the metal cover and the radiation body.

2. The wireless communication device of claim 1, wherein the other one of the second walls defines a substantially U-shaped cutout.

3. The wireless communication device of claim 1, further comprising an USB connector accommodated a space that is defined by the first wall, the two second walls and the two third walls, wherein the first wall defines a through hole configured to expose the connector.

4. The wireless communication device of claim 1, wherein the radiation body and the metal cover cooperatively forms a whole housing of the wireless communication device.

5. The wireless communication device of claim 1, wherein the slit is filled with dielectric materials.

6. A wireless communication device comprising:

an antenna structure comprising:

a radiation body comprising a first wall, two second walls, and two third walls, wherein the second walls are coupled to two opposite ends of the first wall respectively and are parallel to each other; the third walls are coupled to another two opposite ends of the first wall respectively and are parallel to each other; each of the two third walls are coupled between the two second walls;

a grounding portion electronically coupled to the radiation body;

a variable capacitor; and a feeding portion coupled between the radiation body and the variable capacitor;

a printed circuit board comprising:

a grounding point electronically coupled to one end of the grounding portion opposite the radiation body; and a feeding point electronically coupled to one end of the variable capacitor opposite the feeding portion, and configured to output feeding signals to the feeding portion via the variable capacitor; and a metal cover covering on the printed circuit board and insulated from the radiation body, wherein a slit is defined between the metal cover and the radiation body.

7. The wireless communication device of claim 6, wherein the grounding portion and the feeding portion are substantially parallel to each other, and are substantially perpendicularly coupled to one of the second walls.

8. The wireless communication device of claim 7, wherein the other one of the second walls defines a substantially U-shaped cutout.

9. The wireless communication device of claim 6, further comprising an USB connector accommodated a space that is defined by the first wall, the two second walls and the two third walls, wherein the first wall defines a through hole configured to expose the connector.

10. The wireless communication device of claim 6, wherein the radiation body and the metal cover cooperatively forms a whole housing of the wireless communication device.

11. The wireless communication device of claim 6, wherein the slit is filled with dielectric materials.

* * * * *